US012006178B2

(12) United States Patent
Morita

(10) Patent No.: US 12,006,178 B2
(45) Date of Patent: Jun. 11, 2024

(54) SHEET FEED DEVICE

(71) Applicant: RISO KAGAKU CORPORATION, Tokyo (JP)

(72) Inventor: Yoshihisa Morita, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 142 days.

(21) Appl. No.: 17/344,315

(22) Filed: Jun. 10, 2021

(65) Prior Publication Data

US 2022/0002101 A1 Jan. 6, 2022

(30) Foreign Application Priority Data

Jul. 6, 2020 (JP) ..... 2020-116491

(51) Int. Cl.
*B65H 3/48* (2006.01)
*B65H 3/04* (2006.01)
*B65H 3/12* (2006.01)

(52) U.S. Cl.
CPC ..... *B65H 3/48* (2013.01); *B65H 3/047* (2013.01); *B65H 3/128* (2013.01); *B65H 2406/1222* (2013.01); *B65H 2801/06* (2013.01)

(58) Field of Classification Search
CPC ..... B65H 3/047; B65H 3/12; B65H 3/124; B65H 3/128; B65H 3/48; B65H 3/68; B65H 2406/12; B65H 2406/121
See application file for complete search history.

(56) References Cited

U.S. PATENT DOCUMENTS 5,090,676 A * 2/1992 Matsuno ..... B65H 3/12 271/94
8,262,078 B2 9/2012 Shibuya
10,662,009 B2 * 5/2020 Hashimoto ..... B65H 3/14
2001/0017441 A1 * 8/2001 Yamaguchi ..... B65H 3/128 271/9.12
2003/0230843 A1 * 12/2003 Clark ..... B65H 3/128 271/90
2010/0123281 A1 * 5/2010 Yamauchi ..... B65H 7/04 271/3.09

(Continued)

FOREIGN PATENT DOCUMENTS

JP 02-081838 3/1990
JP 2001-233488 8/2001

(Continued)

OTHER PUBLICATIONS

Office Action from Japan Patent Office (JPO) in Japanese Patent Appl. No. 2020-116491, dated Mar. 26, 2024, together with an English language translation.

*Primary Examiner* — Prasad V Gokhale
(74) *Attorney, Agent, or Firm* — Greenblum & Bernstein, P.L.C.

(57) ABSTRACT

A sheet feed device includes: a conveyor configured to convey a top sheet of sheets floated from a sheet stack; a blower configured to blow air in an obliquely upward direction from a position lower than the conveyor toward the sheet stack; and a direction converter configured to convert a direction of the air blown by the blower to a direction which is downward more than a direction of the air at a position where the air is blown from the blower and let the air flow in between the top sheet and a second sheet subsequent to the top sheet of the sheets floated from the sheet stack.

6 Claims, 4 Drawing Sheets

(56) References Cited

U.S. PATENT DOCUMENTS

| | | | | |
|---|---|---|---|---|
| 2016/0107853 | A1* | 4/2016 | Hashimoto | B65H 1/14<br>271/97 |
| 2019/0152730 | A1* | 5/2019 | Hashimoto | B65H 1/04 |

FOREIGN PATENT DOCUMENTS

| | | |
|---|---|---|
| JP | 2008-222400 | 9/2008 |
| JP | 2010-195527 | 9/2010 |
| JP | 2016-078974 | 5/2016 |

* cited by examiner

SHEET FEED DEVICE

CROSS REFERENCE TO RELATED APPLICATION

This application is based upon and claims the benefit of priority from the prior Japanese Patent Application No. 2020-116491, filed on Jul. 6, 2020, the entire contents of which are incorporated herein by reference.

BACKGROUND

1. Technical Field

The disclosure relates to a sheet feed device which feeds sheets.

2. Related Art

As a sheet feed device which feeds sheets, a sheet supply device which blows air to a sheet stack stacked on a sheet feed tray to float sheets, conveys a top (topmost) sheet of the floated sheets while sucking the top sheet with a suction conveyance means, and supplies the top sheet to a printer is known.

In the sheet supply device described above, it is required to separate the top sheet which is sucked and conveyed by the suction conveyance means from the second and subsequent sheets from the top in order to feed a sheet one by one.

Related to the above, Japanese Patent Application Publication No. 2008-222400 describes that a top sheet is separated from a second and subsequent sheets from the top by blowing air in an obliquely upward direction from a downstream side of a sheet stack in a direction of the top sheet conveyed by a suction conveyance means toward the sheet stack (upstream side) and then handling the sheets.

SUMMARY

In Japanese Patent Application Publication No. 2008-222400, the air for separating the sheets is blown in the obliquely upward direction. Hence, a floating force may be generated on the sheets by the air and the top sheet may not be separated enough from the second and subsequent sheets from the top. As a result, problems in sheet feeding such as multiple feeding may be caused.

Arrangement of a blow opening so as to blow air for separating sheets in the horizontal direction may prevent generation of the floating force above. However, this arrangement is impractical because the blow opening of the air and the sheets to be conveyed interfere with each other.

The disclosure is directed to a sheet feed device which can decrease or suppress problems in sheet feeding.

A sheet feed device in accordance with some embodiments includes: a conveyor configured to convey a top sheet of sheets floated from a sheet stack; a blower configured to blow air in an obliquely upward direction from a position lower than the conveyor toward the sheet stack; and a direction converter configured to convert a direction of the air blown by the blower to a direction which is downward more than a direction of the air at a position where the air is blown from the blower and let the air flow in between the top sheet and a second sheet subsequent to the top sheet of the sheets floated from the sheet stack.

According to the aforementioned configurations, problems in sheet feeding can be decreased or suppressed.

DETAILED DESCRIPTION

Figure 1:
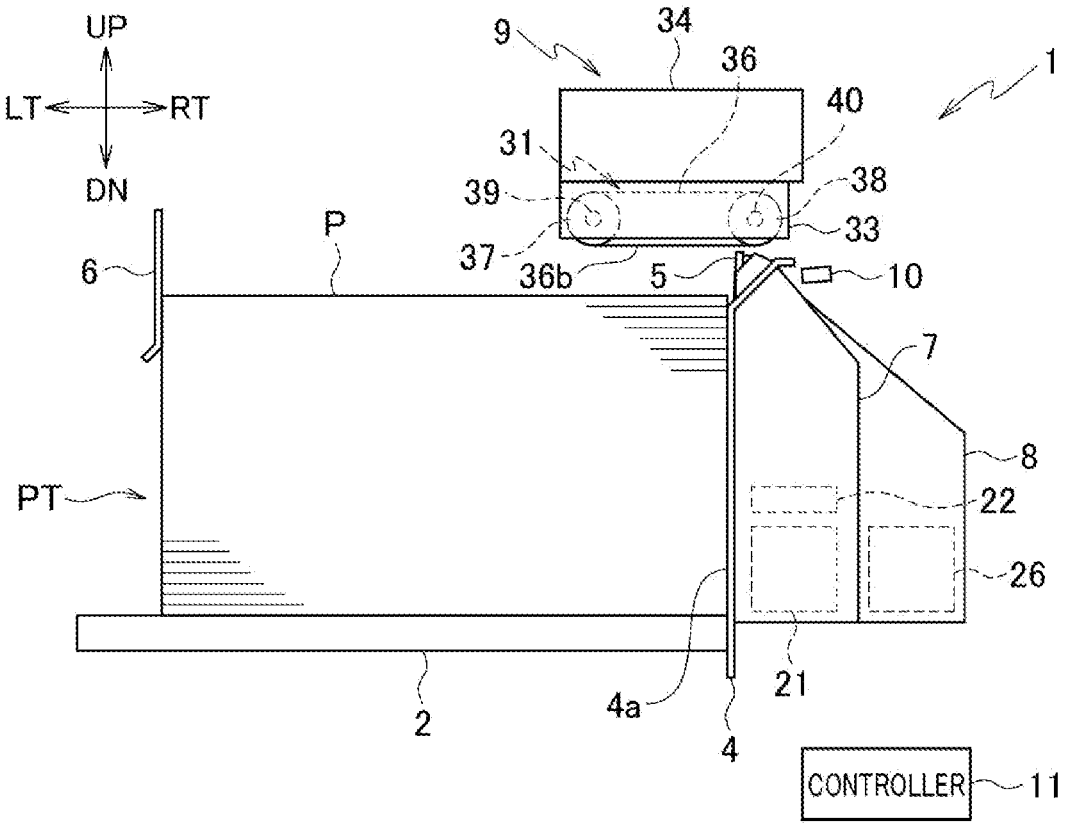
FIG. 1 is a schematic configuration diagram of a sheet supply device according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
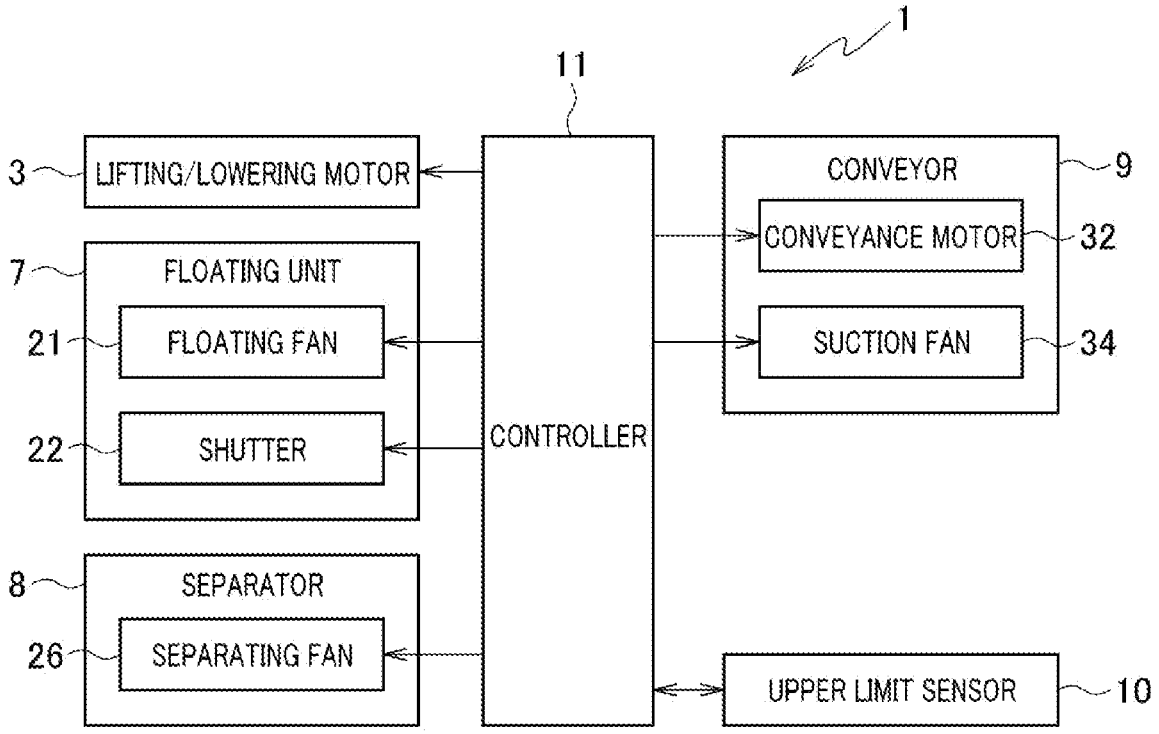
FIG. 2 is a control block diagram of the sheet supply device of FIG. 1.
Figure 3:
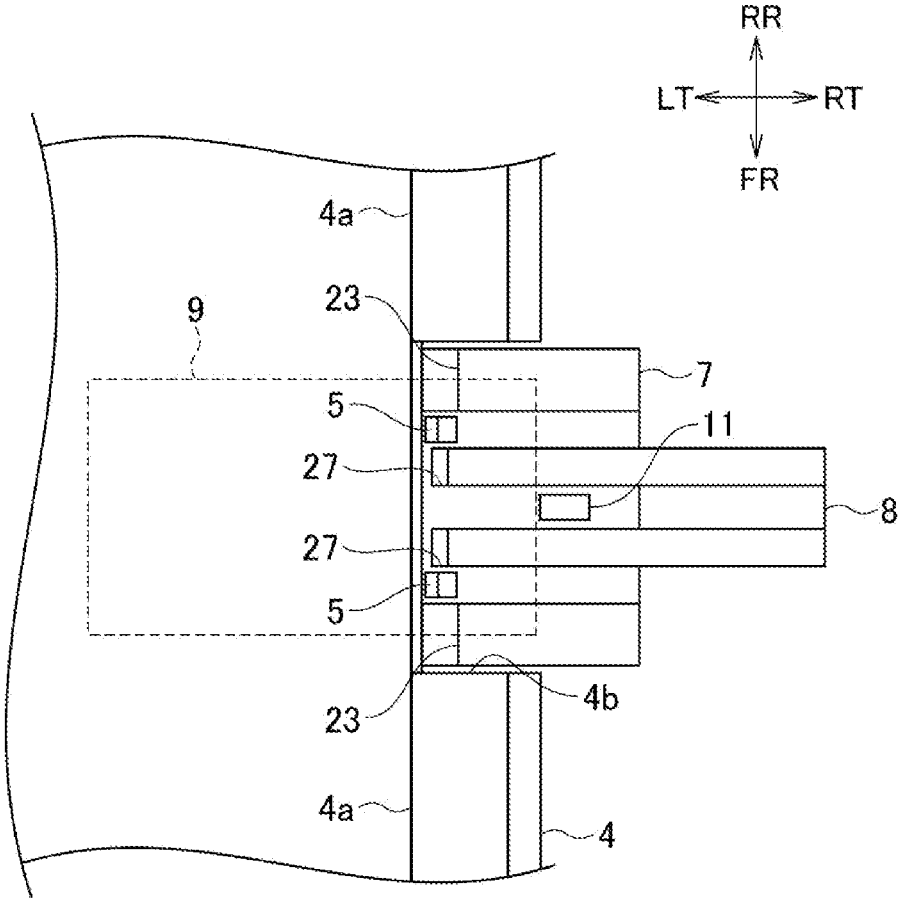
FIG. 3 is a partially enlarged plan view of the sheet supply device of FIG. 1.
Figure 4:
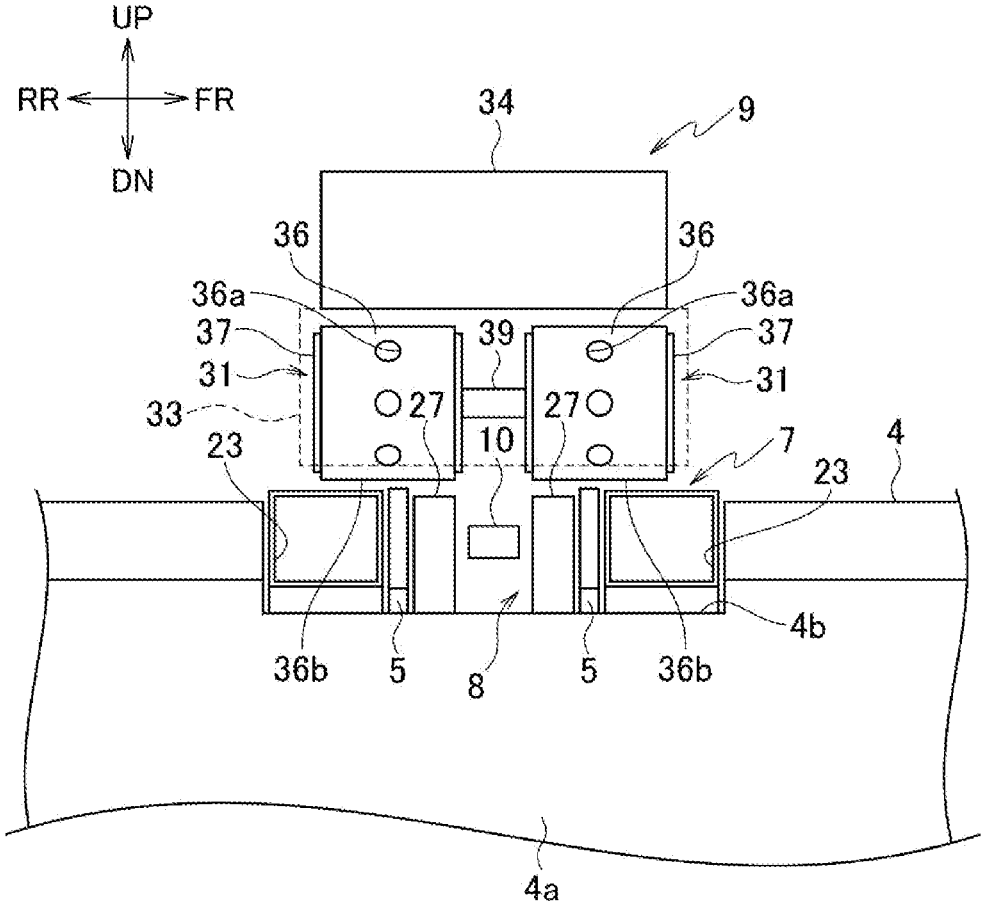
FIG. 4 is an enlarged view near a float air blow opening of the sheet supply device of FIG. 1.

FIG. 1 is a schematic configuration diagram of a sheet supply device 1 according to an embodiment of the invention. FIG. 2 is a control block diagram of the sheet supply device 1 of FIG. 1. FIG. 3 is a partially enlarged plan view of the sheet supply device 1 of FIG. 1. FIG. 4 is an enlarged view near float air blow openings 23 of the sheet supply device 1 of FIG. 1. In the following description, a direction orthogonal to the sheet surface of FIG. 1 is referred to as front-rear direction. Moreover, right and left, and up and down in the sheet surface of FIG. 1 is referred to as up-down direction and as right-left direction. In FIGS. 1 and 3 to 5, right, left, up, down, front, and rear direction are denoted by RT, LT, UP, DN, FR, and RR, respectively.

As illustrated in FIGS. 1 and 2, the sheet supply device (sheet feed device) 1 includes a sheet feed tray 2, a lifting/lowering motor 3, a sheet feed guide plate 4, blocking gates 5, an end fence 6, a floating unit 7, a separator (blower) 8, a conveyor 9, an upper limit sensor 10, and a controller 11.

The sheet supply device 1 is a device which feeds (supplies) sheets P to a printer (not illustrated). The direction from the left toward the right in FIG. 1 is a conveyance direction of a sheet (sheets) P conveyed by the conveyor 9. The conveyance direction of the sheet P conveyed by the conveyor 9 is parallel to a horizontal direction. Upstream and downstream in the following description mean upstream and downstream in the conveyance direction of the sheet P conveyed by the conveyor 9.

Sheets P to be used in printing are stacked on the sheet feed tray 2. The sheet feed tray 2 is capable of being lifted and lowered.

The lifting/lowering motor 3 lifts and lowers the sheet feed tray 2.

The sheet feed guide plate 4 is a member which regulates positions of downstream ends (right ends) of sheets P on the sheet feed tray 2. The sheet feed guide plate 4 is arranged near the downstream side of the sheet feed tray 2. An upper end of the sheet feed guide plate 4 is slanted to have a greater height towards downstream side. The sheet feed guide plate 4 has a vertical guide surface 4*a* which regulates the positions of the downstream ends of sheets P on the sheet feed tray 2. As illustrated in FIGS. 3 and 4, the sheet feed guide plate 4 has a recess 4*b* for blowing air from the floating unit 7 towards sheets P on the sheet feed tray 2. The recess 4*b* is formed by cutting out an upper portion of the sheet feed guide plate 4 in the center thereof in the front-rear direction.

The blocking gates 5 block sheets P other than a top sheet P adhered to (sucked onto) the conveyor 9 among sheets P floated by the floating unit 7. The two blocking gates 5 are arranged apart from each other in the front-rear direction near below a downstream end portion of the conveyor 9.

The end fence 6 is a member which regulates positions of upstream ends (left ends) of sheets P on the sheet feed tray 2.

The floating unit 7 blows air to a paper stack (sheet stack) PT consisting of sheets P stacked on top of one another on the sheet feed tray 2 and float sheets P in an upper portion of the sheet stack PT. The floating unit 7 is arranged at a downstream side of the sheet stack PT. The floating unit 7 includes a floating fan 21, a shutter 22, and two float air blow openings 23.

The floating fan 21 is a generation source of float air flows for floating sheets P of the sheet stack PT on the sheet feed tray 2.

The shutter 22 switches between on and off of blowing the float air flows from the float air blow openings 23.

The float air blow openings 23 are blow openings for the float air flows generated by drive of the floating fan 21. The two float air blow openings 23 are arranged apart from each other in the front-rear direction near below the downstream end portion of the conveyor 9.

Figure 5:
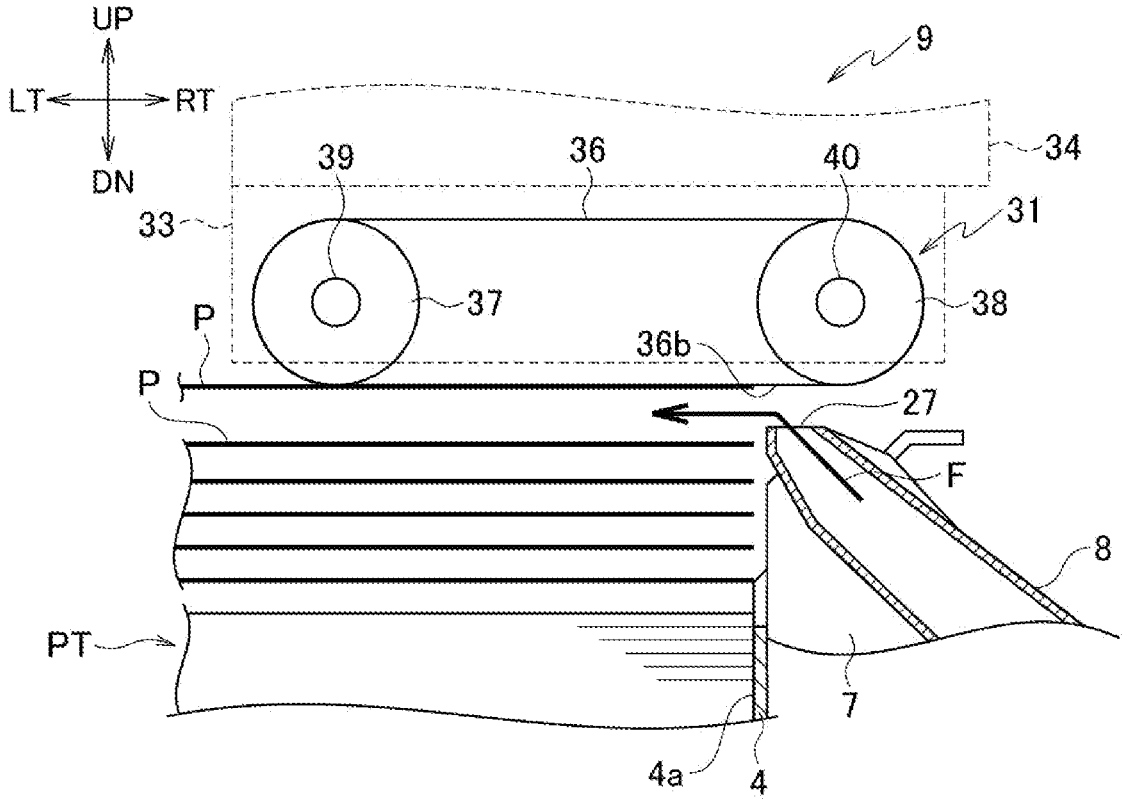
FIG. 5 is an explanatory view explaining a separation air flow.

The separator 8 blows air for separating the top sheet P floated by the floating unit 7 and held by the conveyor 9 from the second and subsequent sheets P from the top and generates separation air flows F (see FIG. 5). The separator 8 is arranged at the downstream side of the sheet stack PT. The separator 8 includes a separating fan 26 and two separation air blow openings (blow openings) 27.

The separating fan 26 is a generation source of the separation air flows F.

The separation air blow openings 27 are blow openings of the separation air flows F. The separation air blow openings 27 blow air (the separation air flows F) in an obliquely upward direction (left obliquely upward direction in FIG. 5) from a position lower than the conveyor 9 toward the sheet stack PT. The two separation air blow openings 27 are arranged in a row in the front-rear direction near below the downstream end portion of the conveyor 9. The two separation air blow openings 27 are arranged in a positional relation such that air flows of the air blown from the respective separation air blow openings 27 collide with each other and a pressure between the top sheet P and the second sheet P from the top is increased due to the collision.

The conveyor 9 holds by air suction the top sheet P among sheets P floated from the sheet stack PT by the float air flows blown from the floating unit 7 and then conveys the top sheet P. The conveyor 9 includes two belt units 31, a conveyance motor 32, a chamber 33, and a suction fan 34.

The belt units 31 conveys each sheet P while holding the each sheet P thereon. The two belt units 31 are arranged in a row in the front-rear direction. The belt units 31 include conveyance belts 36, drive rollers 37, and driven rollers 38.

The conveyance belts 36 are loop belts bridged between the drive rollers 37 and the driven rollers 38. The conveyance belts 36 have belt holes 36*a* formed in the whole circumference of the conveyance belts 36. The conveyance belts 36 hold a sheet P on conveyance surfaces 36*b* by suction force generated at the belt holes 36*a* due to drive of the suction fan 34. The conveyance surfaces 36*b* are horizontal surfaces which are lower surfaces of the conveyance belts 36 located in the lower part of the conveyance belts 36 between the drive rollers 37 and the driven rollers 38. The sheet P is conveyed by rotation (endless movement) of the conveyance belts 36 by drive of the drive rollers 37 with the sheet P held on the conveyance surfaces 36*b*. The conveyance belts 36 is arranged such that right edges (downstream edges) of the conveyance surfaces 36*b* in the right-left direction are located downstream (right side) than the guide surface 4*a* of the sheet feed guide plate 4 in the right-left direction.

The conveyance belts 36 also have a function as a direction converter which converts a direction of the air (the separation air flows F) blown in the left obliquely upward direction by the separator 8 to a horizontal direction and causes the air to flow in between the top sheet P and the second sheet P from the top.

The drive rollers 37 rotate (endlessly move) the conveyance belts 36. The drive rollers 37 of the two belt units 31 are connected to each other by a shaft 39.

The driven rollers 38 support the conveyance belts 36 together with the drive rollers 37. The driven rollers 38 rotate to follow the conveyance belts 36 which are rotating. The driven rollers 38 of the two belt units 31 are connected to each other by a shaft 40.

The conveyance motor 32 rotates the drive rollers 37 by rotating the shaft 39.

The chamber 33 defines a negative pressure chamber for generating the suction force at the belt holes 36*a* of the conveyance belts 36. The chamber 33 holds the belt units 31 therein with the conveyance surfaces 36*b* of the conveyance belts 36 exposed to the outside of the chamber 33. At portions of a bottom plate of the chamber 33 where the conveyance belts 36 pass, ventilation holes (not illustrated) are formed. The suction force is generated at the belt holes 36*a* by air suction into the chamber 33 through the belt holes 36*a* of the conveyance surfaces 36*b* of the conveyance belts 36 and the ventilation holes of the chamber 33.

The suction fan 34 exhausts air from the chamber 33. Exhausting air from the chamber 33 by the suction fan 34 causes air to be sucked from the outside of the chamber 33 into the chamber 33 through the belt holes 36*a* of the conveyance surfaces 36*b* of the conveyance belts 36 and the ventilation holes of the chamber 33. The suction fan 34 is arranged above the chamber 33.

The upper limit sensor 10 monitors downstream (right side) edge surfaces of sheets P stacked on the sheet feed tray 2. The upper limit sensor 10 is arranged downstream of the sheet feed tray 2 and at a height position where the upper limit sensor 10 is able to detect sheets P in a state of being floated by the floating unit 7. The upper limit sensor 10 is a reflective photosensor.

The controller 11 controls the whole processing of the sheet supply device 1. The controller 11 includes a CPU, RAM, ROM, HDD, and the like.

Next, operations of the sheet supply device 1 are described.

The controller 11 opens the shutter 22 when starting sheet feeding. The controller 11 also starts drive of the floating fan 21, the separating fan 26, and the suction fan 34.

By the operation above, the float air flows are blown from the float air blow openings 23 and the separation air flows F are blown from the separation air blow openings 27. Moreover, the suction force is generated at the belt holes 36*a* of the conveyance belts 36.

By the float air flows from the float air blow openings 23, plural sheets P at the uppermost portion of the sheet stack PT are floated from the sheet stack PT and the top sheet P among the floated sheets P is sucked and held onto the conveyance surfaces 36*b* of the conveyance belts 36. In this state, downstream end portions of the conveyance surfaces 36*b* is exposed out of the top sheet P without being covered by the top sheet P.

As illustrated in FIG. 5, the direction of the separation air flows F blown in the left obliquely upward direction from the separation air blow openings 27 is converted to a horizontal upstream (left side) direction by the downstream end portions of the conveyance surfaces 36*b*. The separation air flows F whose direction has been converted are delivered in between the top sheet P and the second sheet P from the top to flow toward the upstream side.

The air flows of the air blown from the two separation air blow openings 27 flow toward the upstream side while colliding with each other. Thus, the pressure between the top sheet P and the second sheet P from the top is increased.

In this state, the controller 11 closes the shutter 22. Accordingly, blowing the float air flows from the float air blow openings 23 are stopped. As a result, the top sheet P is separated from the second and subsequent sheets P from the top by the separation air flows F and then the second and subsequent sheets P from the top fall.

Next, the controller 11 causes the conveyor 9 to convey the top sheet P by driving the conveyance motor 32. Next, the controller 12 opens the shutter 22 to float sheets P for feeding the next sheet P.

By repeating the above operations, each sheet P is sequentially fed from the sheet supply device 1 to the printer.

In the sheet feeding operation, the controller 11 performs a control of lifting the sheet feed tray 2 in response to decrease of the sheets P on the sheet feed tray 2 due to sheet feeding. Specifically, the controller 11 acquires a sensor value of the upper limit sensor 10 during floating of sheets P each time each top sheet P is conveyed (fed). Then, when the acquired sensor value is less than a following threshold value, the controller 11 lifts the sheet feed tray 2 by a height depending on the difference between the acquired sensor value and the following threshold value. When sheet feeding of the number of sheets P to be fed for the sheet feed operation is completed, the controller 11 terminates the sheet feed operation.

As described above, in the sheet supply device 1, the conveyance belts 36 convert the direction of the air (the separation air flows F) blown in the left obliquely upward direction by the separator 8 to the horizontal direction and cause the air to flow in between the top sheet P and the second sheet P from the top. Converting the direction of the separation air flows F in this way prevents generation of a floating force on the sheets P due to the separation air flows F. Thus, a failure in separation of the top sheet P from the second and subsequent sheets P from the top can be decreased and problems in sheet feeding such as multiple feeding can be decreased.

In the sheet supply device 1, the conveyance belts 36 also have the function as the direction converter which converts the direction of the separation air flows F. Thus, the direction of the separation air flows F can be converted in the vicinity of sheets P in the state of being floated and the air can be efficiently delivered in between the top sheet P and the second sheet P from the top. As a result, a failure in separation of the top sheet P from the second and subsequent sheets P from the top can be more decreased and problems in sheet feeding such as multiple feeding can be more decreased. Furthermore, a dedicated member as the direction converter is not required and thus complication of the apparatus configuration can be prevented.

In the sheet supply device 1, the separator 8 includes the two separation air blow openings 27. Thus, since the air flows of the air blown from the two separation air blow openings 27 flow toward the upstream side while colliding with each other, it is possible to increase the pressure between the top sheet P and the second sheet P from the top. As a result, a failure in separation of the top sheet P from the second and subsequent sheets P from the top can be more decreased and problems in sheet feeding such as multiple feeding can be more decreased.

Note that the direction converter which converts the direction of the separation air flows F may be formed as a separate member from the conveyance belts 36. For example, a member which functions as the direction converter may be provided at the downstream side of the conveyance belts 36 such that the separation air flows F blown in the left obliquely upward direction by the separator 8 collide with this member.

Although the configuration in which the two separation air blow openings 27 are provided in the separator 8 is described in the embodiment above, the number of the separation air blow openings 27 is not limited to two. Three or more separation air blow openings 27 may be provided such that an air flow of air blown from the respective separation air blow opening 27 collides with air flows of air blown from the other separation air blow openings 27 and the pressure between the top sheet P and the second sheet P from the top is increased. Since there is an effect that the top sheet P is separated from the second sheet P from the top by a separating fan(s) of the number less than the number of separation air blow openings, electricity for driving the separating fan can be decreased compared with the configuration in which the number of a separation air blow opening(s) and the number of a separating fan(s) are the same.

The number of the separation air blow openings 27 may be one.

In addition to the separator 8 described in the embodiment above, there may be further provided two separating mechanisms (blower) which are arranged to face each other with the sheet stack PT on the sheet feed tray 2 therebetween in the front-rear direction and each of which blows air for separating the top sheet P from the second and subsequent sheets P from the top. Furthermore, these separating mechanisms may blow air in the obliquely upward direction toward the sheet stack PT and convert a direction of the air to a horizontal direction by a direction convertor to deliver the air in between the top sheet P and the second sheet P from the top. Also in this case, the direction convertor may be a function of the conveyance belts 36 or may be formed as a separate member from the conveyance belts 36. Also in this case, the number of a blow opening(s) from which the separating mechanisms (blower) blow air may be one or plural.

In addition to the floating unit 7 described in the embodiment above, there may be further provided two floating mechanisms which are arranged to face each other with the sheet stack PT on the sheet feed tray 2 therebetween in the front-rear direction and each of which blows air to the sheet stack PT for floating sheets P.

Although the configuration in which the direction of the air blown in the left obliquely upward direction by the separator 8 is converted to the horizontal direction is described in the embodiment above, the converted direction is not limited to this and the direction of the air may be converted to a direction which is downward more than the direction of the air when the air is blown (in other words, to a direction which is downward more than a direction of the air at a position where the air is blown from the separation air blow openings 27 of the separator 8). Converting the direction of the air flows in this way decreases a floating force to be generated on the sheets P. Thus, a failure in separation of the top sheet P from the second and subsequent sheets P from the top can be decreased and problems in sheet feeding such as multiple feeding can be decreased.

Although the sheet supply device which feeds sheets such as paper is described in the embodiments above, the disclosure can be also applied to a device which feeds sheet-like material other than paper.

The embodiment of the disclosure has, for example, the following configuration.

A sheet feed device in accordance with some embodiments includes: a conveyor configured to convey a top sheet of sheets floated from a sheet stack; a blower configured to blow air in an obliquely upward direction from a position lower than the conveyor toward the sheet stack; and a direction converter configured to convert a direction of the air blown by the blower to a direction which is downward more than a direction of the air at a position where the air is blown from the blower and let the air flow in between the top sheet and a second sheet subsequent to the top sheet of the sheets floated from the sheet stack.

The conveyor may include a conveyance belt configured to convey each sheet in a conveyance direction, and the conveyance belt may have a function as the direction converter.

The blower may include blow openings from which air is blown.

The conveyance belt may include a conveyance surface configured to suck and hold the top sheet, and the direction converter may include a downstream end portion of the conveyance surface in the conveyance direction.

The sheet feed device may further include: a sheet feed tray on which the sheet stack is placed; and a sheet feed guide plate including a guide surface configured to regulate positions of downstream ends of sheets on the sheet feed tray in the conveyance direction. A downstream edge of the conveyance surface in the conveyance direction may be located downstream than the guide surface in the conveyance direction, and the downstream end portion of the conveyance surface may be exposed out of the top sheet which is sucked and held on the conveyance surface prior to conveyance of the top sheet.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet feed device comprising:

a conveyor configured to convey a top sheet of sheets floated from a sheet stack;

a separating blower mechanism having a separating blower configured to blow first air in an obliquely upward direction from a position lower than the conveyor toward the sheet stack;

a floating blower mechanism having a floating blower configured to blow second air through float air blow openings toward the sheet stack to float at least the top sheet of the sheets from the sheet stack, the floating blower mechanism being positioned lower than the conveyor; and a controller configured to control operation of the floating blower mechanism and the separating blower mechanism, wherein the separating blower includes a separation air blow opening from which the first air blown by the separating blower is directed in the obliquely upward direction, the separation air blow opening being below a downstream end portion of the conveyor in a vertical direction, the separation air blow opening is directly between the float air blow openings in a front-to-rear direction of the sheet feed device, in a plan view of the sheet feed device, the second air being blown through the float air blow openings to float at least the top sheet of the sheets from the sheet stack, a surface of the conveyor is a direction converter configured to convert the obliquely upward direction of the first air blown by the separating blower to a direction which is less vertical than the obliquely upward direction of the first air at a position where the first air is blown from the separating blower, and direct the converted air to flow in between the top sheet and a second sheet immediately below the top sheet of the sheets floated from the sheet stack, the direction converter changes the obliquely upward direction of the first air from the separating blower to the direction which is less vertical, the controller controls the floating blower mechanism to blow the second air to float at least the top sheet toward the conveyor, which then holds the top sheet while the separating blower mechanism blows the first air and increases pressure between the top sheet and the second sheet, and in a state in which the separating blower mechanism increases the pressure between the top sheet and the second sheet and the top sheet is held by the conveyor, the controller controls the floating blower mechanism to close a shutter, thereby causing the second sheet to fall away from the top sheet.

2. The sheet feed device according to claim 1, wherein the conveyor comprises a conveyance belt configured to convey each sheet in a conveyance direction, and the conveyance belt functions as the direction converter.

3. The sheet feed device according to claim 2, wherein the separating blower includes a plurality of the separation air blow opening from which the first air is blown.

4. The sheet feed device according to claim 2, wherein the conveyance belt comprises a conveyance surface configured to suck and hold the top sheet, and the direction converter comprises a downstream end portion of the conveyance surface of the conveyance belt in the conveyance direction.

5. The sheet feed device according to claim 4, further comprising:

a sheet feed tray on which the sheet stack is placed; and a sheet feed guide plate comprising a guide surface configured to regulate positions of downstream ends of sheets on the sheet feed tray in the conveyance direction, wherein a downstream edge of the conveyance surface of the conveyance belt in the conveyance direction is located downstream of the guide surface in the conveyance direction, and the downstream end portion of the conveyance surface is exposed and uncovered by the top sheet when the top sheet is sucked and held on the conveyance surface prior to conveyance of the top sheet.

6. The sheet feed device according to claim 1, wherein the separating blower includes a plurality of the separation air blow opening from which the first air is blown.

* * * * *